US005323849A

United States Patent [19]

Korczynski, Jr. et al.

[11] Patent Number: 5,323,849

[45] Date of Patent: Jun. 28, 1994

[54] CORROSION RESISTANT SHELL AND TUBE HEAT EXCHANGER AND A METHOD OF REPAIRING THE SAME

[75] Inventors: Joseph F. Korczynski, Jr., Glen Burnie; Dennis W. Suitt, Stevensville, both of Md.

[73] Assignee: The United States of America as represented by the Secretary of the Navy, Washington, D.C.

[21] Appl. No.: 49,778

[22] Filed: Apr. 21, 1993

[51] Int. Cl.[5] ..... F28F 9/04

[52] U.S. Cl. ..... 165/158; 165/159; 165/905

[58] Field of Search ..... 165/81, 82, 158, 159, 165/905

[56] References Cited

U.S. PATENT DOCUMENTS

| | | | |
|---|---|---|---|
| 2,879,115 | 3/1959 | Pierce | 105/82 |
| 4,437,217 | 3/1984 | Lallaye et al. | 165/405 X |
| 4,520,868 | 6/1985 | Grawey | 165/158 |
| 4,714,107 | 12/1989 | Adsett | 165/905 X |
| 5,002,119 | 3/1991 | Geppelt et al. | 165/905 X |
| 5,004,042 | 4/1991 | McMorries, IV et al. | 165/159 X |
| 5,036,903 | 8/1991 | Shook | 165/905 X |
| 5,238,057 | 8/1993 | Schelter et al. | 165/905 X |

FOREIGN PATENT DOCUMENTS

| | | | |
|---|---|---|---|
| 9199 | 1/1987 | Japan | 165/159 |
| 884924 | 12/1961 | United Kingdom | 165/82 |

*Primary Examiner*—John C. Fox

*Attorney, Agent, or Firm*—Gary G. Borda

[57] ABSTRACT

A heat exchanger for use in exchanging heat between corrosive or electrolytic fluids has wetted components which are comprised of corrosion and erosion resistant materials. The use of corrosion and erosion resistant tube sheets, shell, and tubes permits the heat exchanger to operate at high flow rates to produce turbulent flow through the inlet tube sheet and tubes, thereby optimizing transfer efficiency between a corrosive fluid in the tubes and the regenerated fluid pumped through the shell.

In order to eliminate problems of temperature gradient and vibrations at the area where the tubes are joined to the inlet tube sheet, the shell is comprised of an inner and outer shell section to form annular flow diverting chambers therebetween. The inner shell section of each chamber is apertured so that flow is diffused over the entire surface, thereby avoiding direct impingement of fluid over the tubes.

18 Claims, 5 Drawing Sheets

CORROSION RESISTANT SHELL AND TUBE HEAT EXCHANGER AND A METHOD OF REPAIRING THE SAME

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention relates generally to a regenerative heat exchange system for transferring heat from one fluid to another and pertains more particularly to a shell and tube system which is capable of transferring heat between electrolytic or corrosive fluids. The present invention is particularly suited for marine use such as in coastal installations, on drilling platforms, or aboard marine vessels where sea water is used as the cooling fluid.

In conventional marine duty heat exchangers, where sea water is used as the cooling fluid, the tube bundles are constructed of copper-alloy tubes and are mounted within a tubular steel shell. Steel inlet and outlet tube sheets are coupled to the inlet and outlet ends, respectively, of the shell by appropriate flanges and are correspondingly apertured to receive and support the ends of the tubes. Cooling seawater passes through the inlet tube sheet and into the tubes, whereupon heat is transferred thereto by recirculating a heated fluid through the shell.

The steel, copper alloy and other materials presently used in the construction of marine duty heat exchangers are heavy and subject to both corrosion and erosion. Copper alloy tubes are particularly subject to erosion at high fluid velocities. Prior art heat exchangers rely on the maintenance of non-turbulent flow conditions to prevent erosion of the tubes and other wetted components. For example, if sea water is pumped through a ¾" diameter tube at a flow velocity through the center of the tube of approximately 8 ft/sec, laminar flow conditions can be established. Under laminar flow conditions, a thin layer of fluid at the tube walls is maintained at zero velocity, thereby eliminating the problem of erosion.

Unfortunately, however, the same thin layer of fluid at the tube walls which prevents erosion also results in a higher convective resistance and thus impedes heat transfer between the fluids. Since the turbulent flow regimes obtained at fluid velocities of 25 ft/sec or more are required for optimum heat transfer between the fluids, the reduction in erosion achieved by reducing fluid velocity to maintain laminar flow in the tubes comes at the direct expense of heat transfer efficiency.

Another disadvantage of reducing the flow rate of fluid within the pipes is a heightened risk of fouling the sea water side of the inlet tube sheet with biological material. Formations of scale deposits on the inlet side of the heat exchanger are also a problem associated with low flow rates.

It is therefore an object of the present invention to provide an erosion and corrosion resistant heat exchanger apparatus which also provides high transfer efficiency.

It is another object of the present invention to provide a heat exchanger apparatus which can be readily retrofitted into existing installations.

It is yet another object of the present invention to provide a heat exchanger which is resistant to fouling and the formation of scale deposits.

It is still another object of the present invention to provide a method of repairing the tubes within a heat exchanger constructed in accordance with the present invention.

It is also an object of the present invention to eliminate problems caused by tube vibrations at the tube sheets and by temperature gradients within the shell.

SUMMARY OF THE INVENTION

The apparatus for exchanging heat between two fluids comprises a plurality of elongated tubes for carrying a first fluid. Each tube has a first end and a second end and is formed of a first corrosion resistant and erosion resistant material. A first transverse member supports the first end of each tube by defining a plurality of apertures for receiving ends of the tubes and is formed of a corrosion and erosion resistant material. A second transverse member supports the second end of each tube by defining a plurality of apertures for receiving ends of the tubes and is formed of a corrosion and erosion resistant material.

The corrosion and erosion resistant material of the tubes may comprises titanium, carbon fibers in an epoxy resin matrix, or a sintered-alpha silicon carbide ceramic. The corrosion resistant material of the transverse members comprises a cotton reinforced phenolic resin.

The first end of each tube is secured within a respective aperture of the first transverse member by an epoxy adhesive. A plurality of adaptors receive ends of the tubes at one end and engages an aperture of the second transverse member at the other. Each adaptor is formed of a thermally insulating, erosion and corrosion resistant material and comprises a tubular member having an outer surface and means for creating a seal between the outer surface and the second transverse member. The outer surface of the adaptor defines an annular groove for receiving a seal creating means such as an O-ring. The outer surface of each adaptor is adhesively bonded to an interior surface of a tube.

Intermediate support means disposed between adjacent tubes are formed of a material having corrosion and erosion resistance properties and define a serpentine flow path for the fluid flowing between the tubes.

The heat exchanger apparatus further comprises a shell means for housing the tubes for establishing a flow path for a second fluid. The shell means comprising a first tubular member concentrically disposed within a second tubular member. Each of the tubular members has an inlet end region, an outlet end region and an intermediate region therebetween. Each of the tubular members is formed of a thermally insulating, erosion and corrosion resistant material such as a silica reinforced phenolic resin material. The first and second tubular members each have walls defining interior and exterior surfaces. The second tubular member has a uniform inner diameter. The first tubular member has an outer diameter at its intermediate region equal to the inner diameter of the second tubular member but has reduced outer diameters at its inlet and outlet end regions such that the interior surface of said second tubular member and the exterior surface of said first tubular member define annular inlet and outlet chambers therebetween. The annular inlet and outlet chambers substantially surrounds a portion of the exterior surface of the inner tubular member. The shell means also defines an inlet opening through the tubular members for receiving a second fluid therethrough, the annular inlet chamber being in fluid communication with the inlet opening at a position located adjacent the first transverse member, and an outlet opening through the tubular members, for discharging the second fluid therethrough, the annular outlet chamber being in fluid communication with the outlet opening. The periphery of the first tubular member defines a plurality of apertures within the annular inlet chamber for admitting the second fluid therethrough and a plurality of apertures within the annular outer chamber for discharging the second fluid therethrough.

Another embodiment of the heat exchanger apparatus utilizes an alternate means of supporting the ends of the tubes and comprises a plurality of elongated tubes for carrying a first fluid, each tube having a first end and second end and being formed of a thermally conductive, corrosion resistant and erosion resistant material and a shell for housing the elongated tubes and establishing a flow path for a second fluid. The shell is formed of a thermally insulating, corrosion and erosion resistant material.

First support means are coupled to the inlet end of the shell for supporting the first end of each tube and define a barrier between the first fluid and the second fluid. Second support means are coupled to the outlet end of the shell for supporting the second end of each tube and for defining a barrier between said the first fluid and said second fluid. The first and second support means are formed of a thermally insulating, corrosion and erosion resistant material, and each support means comprises first and second plate members and means for sealing between the first and second fluids. The first plate members define a first group of apertures for receiving ends of the tubes and the sealing means, and the second plate members define a second group of apertures for alignment with said first group.

The sealing means of the first plate member comprises a plurality of tubular members having an inner diameter corresponding to the outer diameter of the tubes and a plurality of ring members, wherein each tubular member is disposed between a ring member and one of said second plate members. The apertures of the second group have a smaller diameter than the apertures of the first group, such that an edge surface of each tubular member engages a surface of said second plate member in abutting relation.

First and second tubular head members are coupled at one end to the first and second support means, respectively and are covered at the other end by a cover plate. The head members and covers are formed from a thermally insulating, corrosion resistant and erosion resistant material and define respective inlet and outlet chambers for the first fluid.

A method of repairing a leaking heat exchanger tube formed of carbon fibers in an epoxy resin matrix comprises the steps of removing a tube section having a leak therein from said heat exchanger, cutting the tube into first and second sections at the site of said leak, providing a first tubular segment having similar internal and external diameters to the tube, removing a longitudinal section of the first tubular segment and applying a bonding agent to an outer surface of said first segment, inserting a portion of the first tubular segment into one of the first or second tube sections, inserting the remaining portion of the first tubular segment into the other of the tube sections until the first and second sections are in abutting contact to form a tight joint, providing a second tubular segment having similar internal and external diameters to the first tubular segment, longitudinally cutting the second tubular segment along its entire length, expanding the second tubular segment to achieve an inner diameter slightly greater than the external diameter of the leaking tube, sliding the second tubular segment into a position overlying the tight joint and bonding the second tubular segment thereto.

Where the leak is not severe, an alternate method of repair comprises the steps of removing a leaking tube having a leak therein from said heat exchanger, providing a first tubular segment having the same internal and external diameters as the leaking tube, longitudinally cutting the first tubular segment along its entire length, expanding the first tubular segment to achieve an inner diameter slightly greater than the external diameter of the leaking tube, and sliding the first tubular segment into a position overlying the leak and bonding the first tubular segment thereto.

Although the apparatus has been described in connection with use of sea water as the cooling fluid, it is contemplated that the exchanger of the present invention would also be adapted for use in chemical processes such as for transferring heat to or from corrosive chemicals.

DETAILED DESCRIPTION OF THE INVENTION

Figure 1:
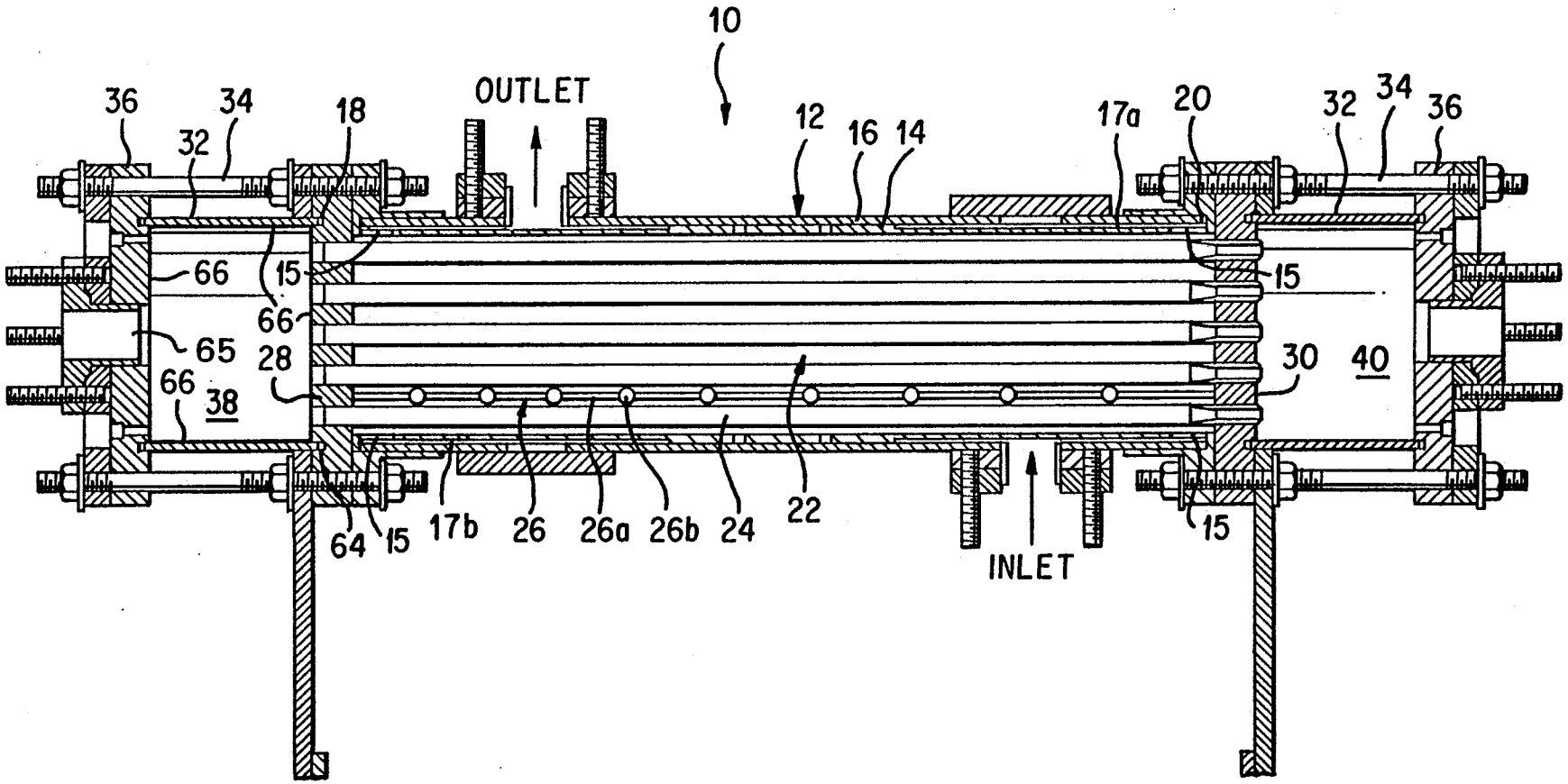
FIG. 1 is a cross-sectional view of a heat exchanger apparatus constructed in accordance with the present invention.

Referring to FIG. 1, the invention embodied therein comprises an apparatus for exchanging heat between a first fluid and a second fluid, and in particular for transferring heat from a recirculated fluid to a corrosive or electrolytic fluid such as sea water, salt water, or brackish water.

Heat exchanger 10 includes a tubular shell 12 comprising an inner tubular member 14 and an outer tubular member 16 and having an inlet end 18 and an outlet end 20. Shell 12 houses a tube bundle 22 which comprises a plurality of parallel, spaced tubes 24 and a plurality of tube supporting members 26 for maintaining the tubes in spaced longitudinal relationship. Inlet and outlet tube sheets, 28 and 30, respectively, receive and support opposite ends of the tubes 24. A tubular head 32 is coupled by tie rods 34 to each tube sheet by a centrally apertured cover plate 36 to form inlet and outlet chambers 38 and 40.

In order to permit utilization of a corrosive or electrolytic cooling fluid, the tubes 24 are constructed of a corrosive resistant metal, metal alloy, fiber reinforced polymer matrix, or ceramic material having appropriate thermal conductivity characteristics. Examples of acceptable materials include titanium, sintered-alpha silicon carbide ceramics, and carbon fiber polymer resin matrix materials. Preferably, the tubes are made from a material comprising filament-wound carbon fibers in an epoxy resin matrix. Tubes constructed of such material provide superior erosion resistance, outstanding corrosion resistance and low weight, yet also demonstrate adequate thermal conductivity and burst/collapse pressure strength.

Figure 2:
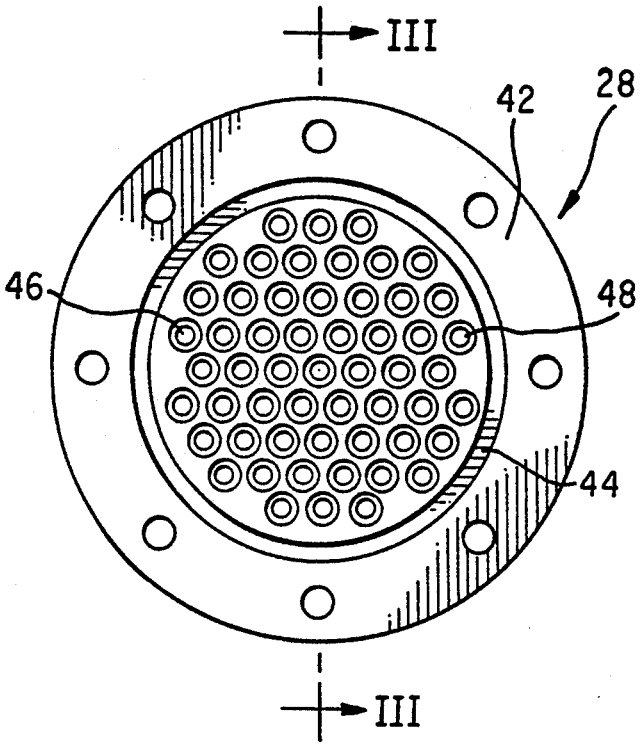
FIG. 2 is a partial elevation view of an inlet tube sheet constructed in accordance with the present invention.
Figure 3:
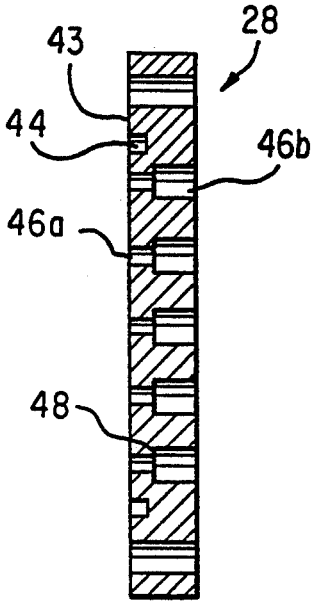
FIG. 3 is a cross sectional view, taken across line III—III of FIG. 2, of the inlet tube sheet shown in FIG. 2.

The embodiment of the inlet tube sheet 28 shown in FIG. 2 is constructed for supporting the tubes at the inlet end of the shell. Sheet 28 comprises a plate 42 having an outer face 43 which faces the incoming fluid and which preferably has an annular recess 44 formed therein. Within the area circumscribed by the annular recess 44 are a plurality of apertures 46 through plate 42 for receiving respective inlet ends of the tubes 24. As best shown in FIG. 3, each aperture is divided into two sections, 46*a* and 46*b*. Section 46*b* is of a diameter corresponding to the external diameter of tubes 24 and is adapted to receive and support the same. Section 46*a* opens to outer face 43 and is of a reduced diameter, thereby defining a step or abutment 48 against which the end of a tube 24 is seated.

Figure 4:
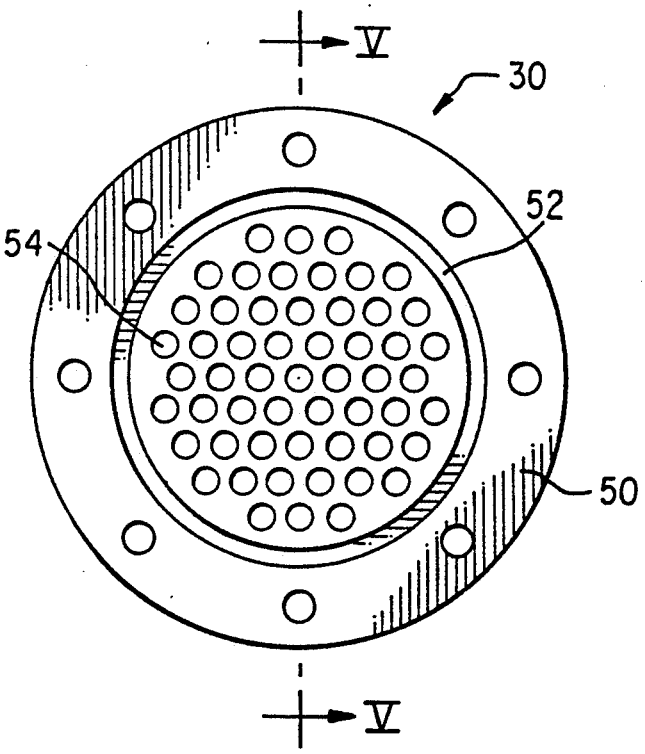
FIG. 4 is a partial elevation view of an outlet tube sheet constructed in accordance with the present invention.
Figure 5:
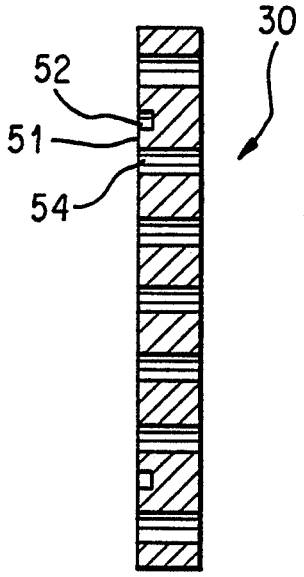
FIG. 5 is a cross sectional view, taken across line V—V in FIG. 4, of the outlet tube sheet.

With reference now to FIG. 4, the outlet tube sheet 30 will now be described. Tube sheet 30 is constructed for supporting the tubes at the outlet end of the shell and comprises a plate 50 having an outer face 51 with an annular recess 52 formed thereon. Within the area circumscribed by the annular recess 52 are a plurality of apertures 54. As shown in FIG. 5, the apertures 54 in sheet 30 are preferably of a constant diameter.

Figure 6:
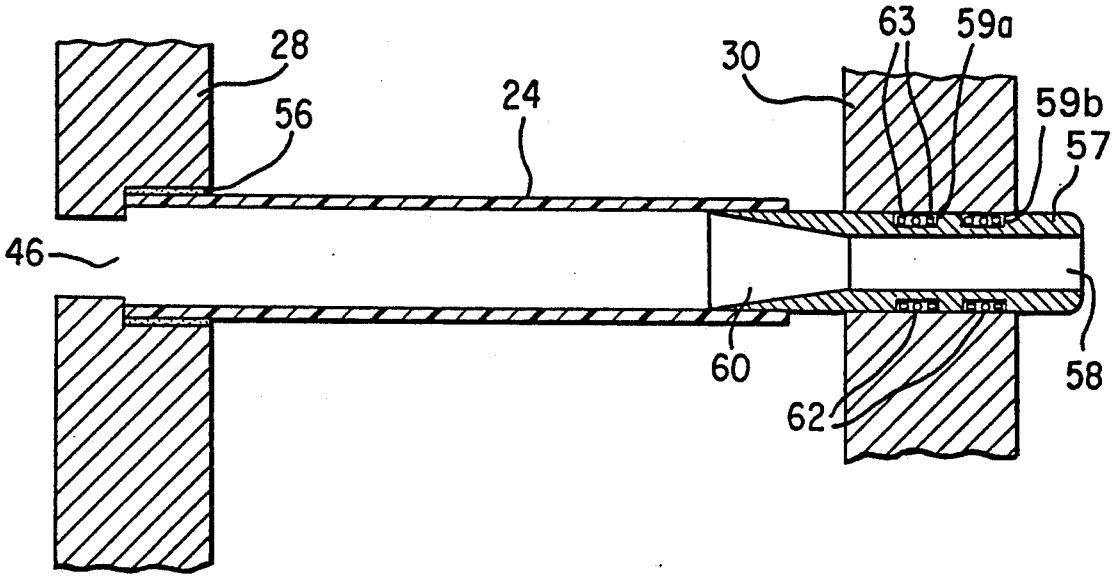
FIG. 6 is a cross sectional view, showing the interconnection of a tube to the inlet and outlet tube sheets in accordance with the present invention.

With reference now to FIG. 6, the connection of the tube ends to the respective tube sheets will now be described. The inlet tube sheet 28 defines a fixed end of the tube bundle, and the inlet ends of tubes 24 are sealingly maintained within the apertures 46 therein by any conventional manner. Preferably, the tube ends are adhesively bonded within aperture sections 46*b* by an epoxy adhesive 56 to form a fixed joint therewith.

The second or outlet tube sheet 30 defines a free end of the tube bundle. Each aperture 54 is dimensioned to receive a respective tube mounting adapter 57. Each tube mounting adapter 57 is substantially cylindrical and comprises an axial bore 58 and two annular recesses 59*a*, 59*b* on its exterior surface. At one end of the tube mounting adapter 57, the axial bore 58 includes an entry portion 60 which is received in the outlet end of a tube 24. In use, the end of the adaptor defining the entry portion 60 is adhesively bonded within the outlet end of a tube 24 and the other end of the adapter is positioned within an aperture 54 of the outlet tube sheet. To provide a fail safe sealing between the two fluids, O-rings 62 are inserted into annular recesses 59*a* and 59*b* for engagement with the interior wall of an aperture 54. Retaining rings 63 may be inserted on opposite sides of each O-ring.

The shell, tube sheets, and tube adaptors may be fabricated from any materials having sufficient thermal insulating, erosion and corrosion resisting and good machinability properties. The tube adapter material must also allow thermal expansion and contraction of the tubes through the tube sheets. Although the preferred material for the shell, tube sheets, and adaptors is a glass or cotton fiber reinforced phenolic resin, other glass or carbon-fiber reinforced polymers, such as epoxy, polyamide, or polyimide resins are also suitable. These materials can permit much higher seawater velocities than conventional copper-nickel alloys, can provide pressure ratings of at least 150 psi at 200° F., dampen vibration and flow generated noise, help to reduce magnetic signatures, and reduce overall assembly weight by over 50 percent.

With reference to FIG. 1, the heads 32 and covers 36 will now be described. Each cover 36 is essentially a circular plate having a central aperture 65 and a plurality of bores for receiving tie rods 34. Each cover 36 also include an annular recess which is dimensioned to receive one end of a tubular head 32. A nitrile rubber gasket 64 is seated within the recess to provide a tight, leakage resistant seal between a first end of the head and the cover. When completely assembled in the manner shown in FIG. 1, the second end of the tubular head 32 is received in a gasketed annular recess 44 or 52 of the tube sheets and the components are held together by stainless steel tie rods to form the inlet and outlet chambers, 38 and 40, respectively.

Although the present invention decreases fouling by permitting high fluid flow rates through the inlet chamber, it is possible to further reduce fouling within the inlet chamber by coating the outer face of the inlet tube sheet and the interior of the head with a copper or organometallic antifoulant coating. Preferably, a copper alloy coating 66 is flame sprayed onto all surfaces within the inlet chamber.

Figure 7:
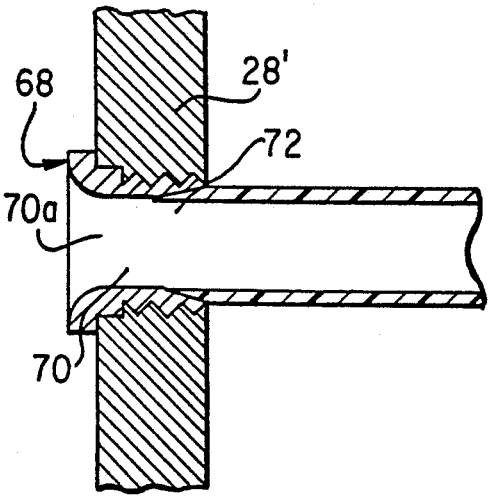
FIG. 7 is a partial cross sectional view showing a modified construction of the inlet tube sheet and an adapter for connecting the tube thereto.

With reference now to FIG. 7, an alternate inlet tube sheet and a means for securing the inlet tube end thereto will now be described. Modified inlet tube sheet 28′ is constructed in a similar manner to and using the same materials as the embodiment shown in FIG. 2. However, in lieu of having a reduced diameter section for seating the inlet end of a tube, each aperture 46′ is threaded and receives an externally threaded inlet adapter 68. Each inlet adapter acts as a funnel for the incoming fluid and includes an axial bore 70 having a fluted inlet section 70*a* into which the incoming fluid is directed. An outlet section 72 of the axial bore receives the end of the tube. Any conventional means of joining the tube end to the inlet tube sheet may be used to prevent leakage between the fluids. For example, a suitable adhesive may be used at the joint between the tube wall and the interior of the inlet adapter. If desired, the interior of the adapter may have a stepped diameter and a nitrile rubber gasket may be used at the interface between the end of the tube and the abutment formed by the decreased diameter section of the bore.

With reference now to FIG. the tubes 24 are preferably spaced from one another along their lengths by a plurality of tube support members 26. Each tube support member 26 preferably comprises an elongated rod 26a having a plurality of projecting supports 26b disposed at spaced intervals therealong. Spacing of the supports permits serpentine flow of fluid around the tubes to enhance thermal conductivity.

The projecting supports 26b may be integrally formed during manufacture of the rod 26a or may be provided with a central bore and adhesively bonded to the rod in a separate operation. The tube support members 26 may be manufactured from any material having suitable corrosion resistance and heat strength. Preferably, however, they are formed from a thermoplastic material such as glass reinforced polyamide-imide resin.

Figure 8:
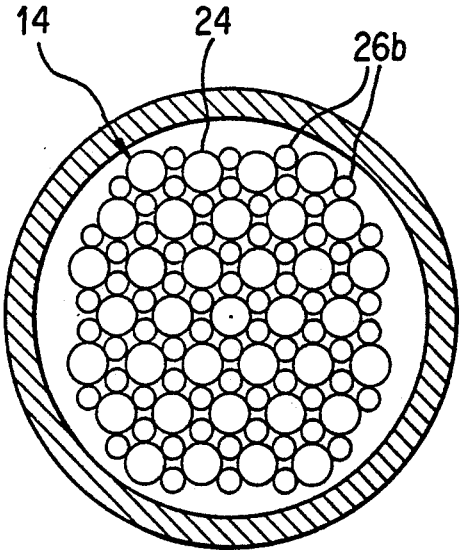
FIG. 8 is a cross sectional view of the tube bundle and shell showing an arrangement of tube supports between the tubes.

Since the purpose of the tube support members 26 is to engage and support the surfaces of the tubes 24, it should be understood that the projecting supports 26b may be of any geometrical configuration. For example, they may have a circular cross section, such as a cylinder or sphere, or they may have a polygonal cross section. The surface of supports 26b may also be provided with recesses corresponding to the external contour of the tubes to provide support over a larger area and thereby minimize radial stresses in the tube. In the preferred embodiment, however, spherical supports are used. A cross section of the tube bundle showing a possible arrangement of tubes and rod support members is shown in FIG. 8.

Figure 9:
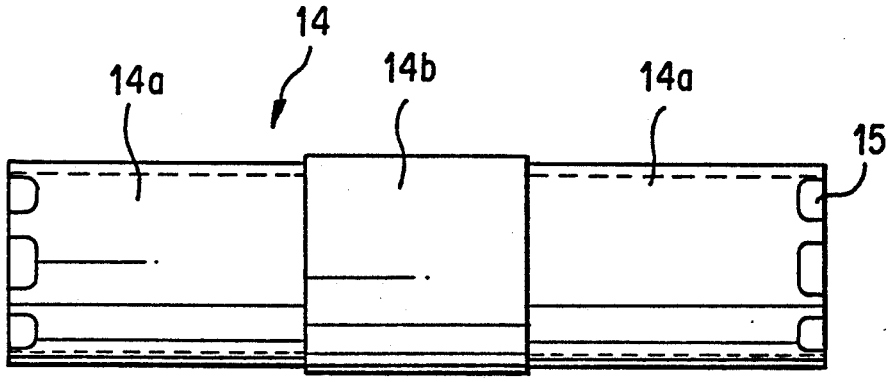
FIG. 9 is a plan view of the inner shell constructed in accordance with the present invention.
Figure 10:
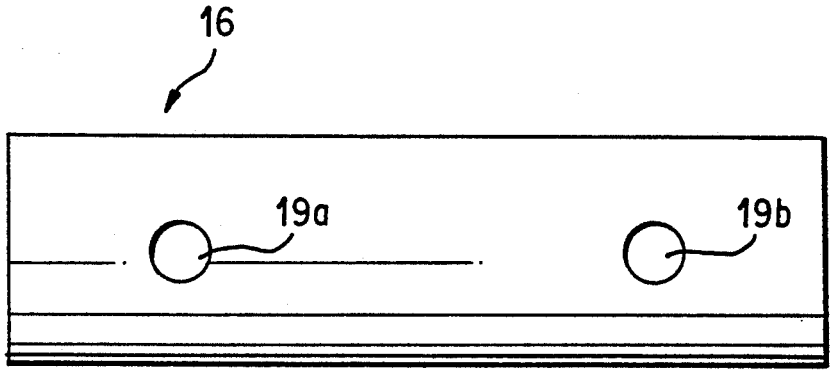
FIG. 10 is a plan view of the outer shell constructed in accordance with the present invention.

With reference to FIGS. 9, and 10, shell 12 comprises an inner tubular member 14 and an outer tubular member 16. As shown in FIG. 9, tubular member 14 comprises an intermediate region 14b having an outer diameter corresponding to the inner diameter of tubular member 16. At both the inlet and outlet ends, however, the tubular member 14 has a reduced outer diameter region 14a. A plurality of apertures 15 are formed at each end of tubular member 14 in the reduced diameter regions.

Preferably, the apertures 15 are provided as arcuate recesses along the edges of the inner tubular member. However, they may be provided in any geometric shape and at any location within the region 14a.

As shown in FIG. 10, the outer tubular member has a uniform diameter and inlet and outlet openings, 19a and 19b respectively, for admitting and discharging the recirculated fluid into the shell. When inner tubular member 14 is concentrically mounted within the outer tubular member 16 as shown in FIG. 1, the area between regions 14a and the outer tubular member 16 define respective annular flow diverting chambers 17a and 17b. Fluid entering through the inlet 19a is directed first into the annular chamber 17a and then through the apertures 15, thereby eliminating any vibrations of the tubes which would otherwise be caused by direct impingement on the tubes by the incoming fluid. Temperatures of the fluid within the shell are also made more uniform by diffusing the flow over the entire circumference of the shell. After circulating through shell 12, fluid discharges from apertures 15 into annular chamber 17b and then from outlet opening 19b.

Figure 11:
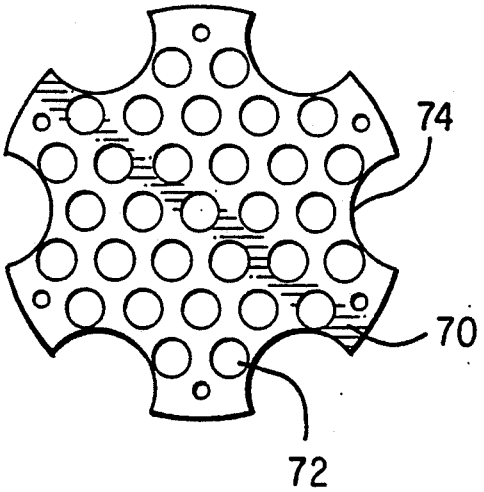
FIG. 11 is a plan view of a first baffled tube support plate for use in the heat exchanger of the present invention.

A spaced arrangement of aligned baffle plates positioned within the shell might also be used instead of the support member arrangement shown in FIG. 1. FIG. 11 shows a disk shaped baffle plate 70 having apertures 72 for receiving and supporting sections of tube 24. Circumferential recesses 74 along the periphery of the baffle plate 70 permit fluid to pass through the shell without excessive reduction in the flow rate.

Figure 12:
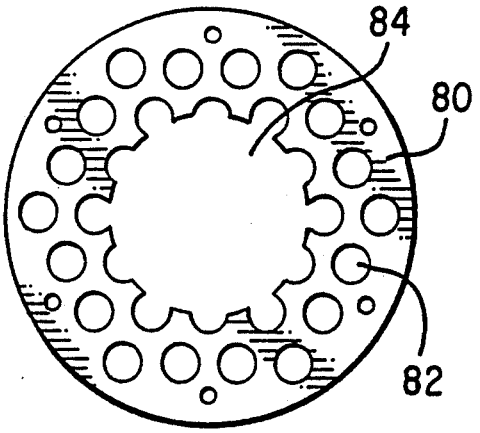
FIG. 12 is a plan view of a second baffled tube support plate for use in the heat exchanger of the present invention.

FIG. 12 shows an annular baffle plate 80 having a plurality of receiving apertures 82 and a large central opening 84. By alternating between disk shaped and toroidally shaped baffles within the shell, adequate support of the tubes 24 can be achieved while maintaining high velocity, serpentine flow through the shell. The baffle plates may be manufactured from any corrosion and erosion resistant material. Preferably, the baffle plates are constructed from a cotton reinforced phenolic material.

Figure 13:
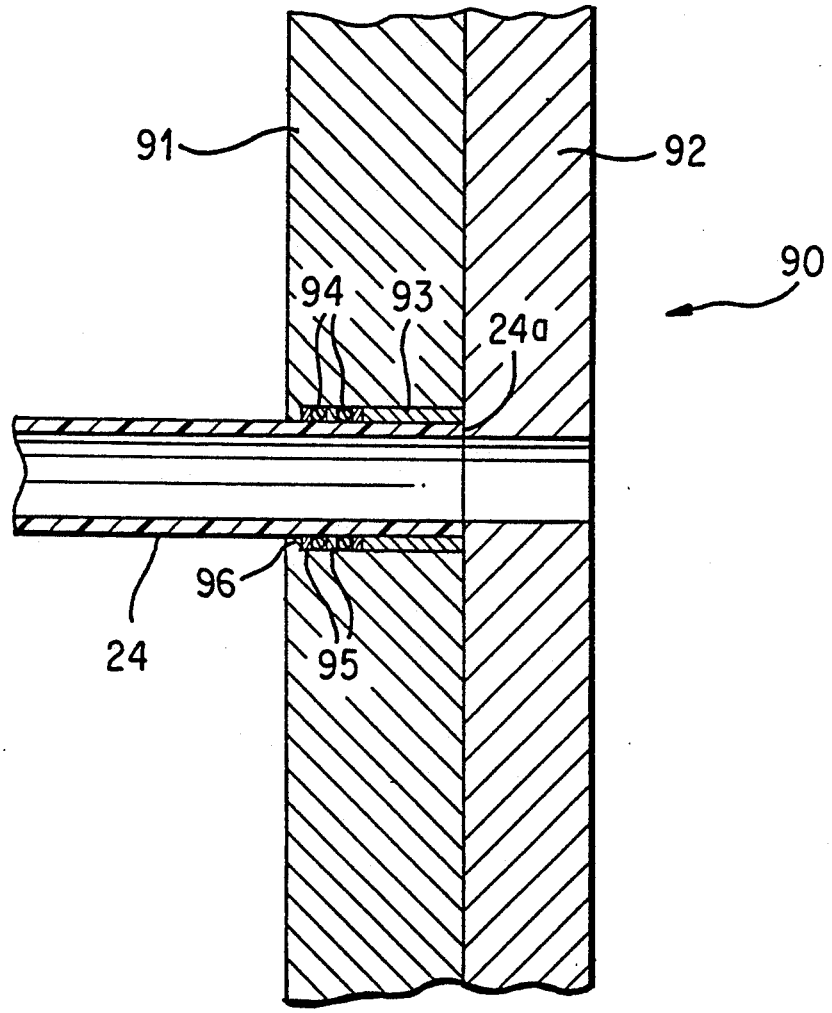
FIG. 13 is a partial cross sectional view of a modified tube sheet design for use in the heat exchanger of the present invention.

With reference now to FIG. 13, a modified tube sheet construction which can be used at both the inlet and outlet ends of the tube bundle will now be described. The modified tube sheet 90 is comprised of two laminar sections, 91 and 92. Inner section 91 defines a first group of apertures such that each aperture has a diameter slightly greater than the outer diameter of the tubes and receives and supports the ends of the tubes 24 therein. A tubular segment 93 is positioned on the end of each tube to maintain the tubes centrally within the apertures of inner section 91. A plurality of sealing means such as an alternating arrangement of O-rings 94 and retaining rings 95 are also positioned on the tubes and these are seated within the first group of apertures adjacent tubular segment 93 and abutment 96 to prevent leakage between the respective fluids.

Outer section 92 defines a second group of apertures which are in alignment with the first group. The edges of tubes 24 and segments 93 surrounding them abut against the surface of outer section 92 which faces the shell.

When the tubes 24 are constructed of slightly flexible materials such as those comprising carbon filaments in an epoxy resin matrix, they may be easily repaired in the field without completely removing them from the heat exchanger. To do so, the tube affected is positioned to expose the damaged or leaking section. Where only minor damage exists, a single tubular segment of the same cross sectional dimensions as and formed of the same material as the tube can be used to repair it. A longitudinal cut is made in the segment, a suitable adhesive is applied to the surface of the damaged tube or to the interior of the segment itself and the segment is slid into position over the damaged area. Where more extensive damage exists two segments can be used for repair of the tube. This type of repair requires a transverse cutting of the tube at a site adjacent the damaged area. An exterior tube repair segment is prepared in a manner identical as that explained above. An interior tube repair segment is prepared by removing a narrow, longitudinal section of material therefrom. This is done by making two closely spaced longitudinal cuts along the entire length of a tubular segment. Once the interior repair segment is prepared, it is compressed by external pressure and a portion of it is inserted into one of the tube sections at the site of the cut. An adhesive bonding agent should be applied to the interior of the tube and the exterior of the interior repair segment. The other end of the interior repair segment is compressed, treated with adhesive, and then inserted into the other tube.

Thereafter, the two tube sections can be pushed together to create a close fitting joint and the first segment can be slid into position over the joint. Preferably, the location of the slits in the interior repair section is oriented 180 degrees from the slit in the exterior repair section. Once the adhesive has dried, the repaired tube can be slid back into position within the tube bundle.

As will be apparent to those of ordinary skill in the art, various modifications and adaptations of the structure above described will become readily apparent without departure from the spirit and scope of the invention, the scope of which is defined in the appended claims.

What is claimed is:

1. An apparatus for exchanging heat between two fluids comprising:

a plurality of elongated tubes for carrying a first fluid, each tube having a first end and a second end and being formed of a thermally conductive fiber-reinforced polymer matrix material having corrosion resistance and erosion resistance properties;

a shell means for housing said tubes and for establishing a flow path for a second fluid, said shell means comprising a first tubular member and a second tubular member, each of said tubular members having an inlet end region, an outlet end region and an intermediate region therebetween, said first tubular member being concentrically disposed within said second tubular member, wherein each of said tubular members formed of a thermally insulating fiber-reinforced polymer material having corrosion and erosion resistance properties;

a first transverse member coupled to said inlet end regions of said tubular members for supporting the first end of each tube, said first transverse member defining a plurality of apertures for receiving a respective first end of a tube and being formed of a thermally insulating cotton reinforced phenolic resin material having corrosion and erosion resistance properties; and a second transverse member coupled to said outlet end regions of said tubular members for supporting the second end of each tube, said second transverse member defining a plurality of apertures for receiving a respective second end of a tube and being formed of said thermally insulating cotton reinforced phenolic resin material.

2. The apparatus of claim 1, wherein said thermally conductive material comprises titanium.

3. The apparatus of claim 1, wherein said thermally conductive fiber-reinforced polymer matrix material comprises filament wound carbon fibers in an epoxy resin matrix.

4. The apparatus of claim 1, wherein said thermally conductive material comprises a sintered-alpha silicon carbide ceramic.

5. The apparatus of claim 1, wherein the first end of each tube is secured within a respective aperture of said first transverse member by an epoxy adhesive.

6. The apparatus of claim 1, further comprising a plurality of adaptors, each adaptor having a first end for receiving the second end of a tube and a second end for engagement with an aperture of said second transverse member, wherein an outer surface of said first end of each adaptor is adhesively bonded to an interior surface of said second end of each tube.

7. The apparatus of claim 6, wherein said adaptors are formed of said thermally insulating cotton reinforced phenolic resin material.

8. The apparatus of claim 7, wherein each of said adaptors comprises a tubular member having an outer surface and further wherein said second end of each adaptor includes means for creating a seal between said outer surface and said second transverse member, said outer surface defining an annular groove for receiving said seal creating means.

9. The apparatus of claim 1, further comprising intermediate support means disposed between adjacent tubes and defining a serpentine flow path between said tubes, said intermediate support means being formed of a thermoplastic material having corrosion and erosion resistance properties.

10. The apparatus of claim 1, wherein said thermally insulating fiber-reinforced polymer material of said first and second tubular members is a silica reinforced phenolic resin material.

11. The apparatus of claim 1, wherein said first and second tubular members each have walls defining interior and exterior surfaces, said second tubular member having a uniform inner diameter corresponding to said interior surface, said first tubular member having an outer diameter at said intermediate region equal to said inner diameter of said second tubular member and further having reduced outer diameters at said inlet and outlet end regions such that the interior surface of said second tubular member and the exterior surface of said first tubular member define annular inlet and outlet chambers therebetween, said annular inlet and outlet chambers substantially surrounding at least a portion of the exterior surface of said first tubular member at said inlet and outlet end portions.

12. The apparatus of claim 11 wherein said shell means defines at least one inlet opening through said first and second tubular members within said inlet end portions for receiving said second fluid therethrough and at least one outlet opening through said first and second tubular members within said outlet end portions for discharging said second fluid therethrough, said annular inlet chamber being in fluid communication with said at least one inlet opening and said annular outlet chamber being in fluid communication with at least one outlet opening.

13. The apparatus of claim 12 wherein the periphery of said first tubular member defines a plurality of apertures within said annular inlet chamber for admitting said second fluid therethrough and further defines a plurality of apertures within said annular outlet chamber for discharging said second fluid therethrough.

14. The apparatus for exchanging heat between two fluids comprising:

a plurality of elongated tubes for carrying a first fluid, each tube having a first end and second end and being formed of filament wound carbon fibers in an epoxy resin matrix;

a shell for housing said elongated tubes and for establishing a flow path for a second fluid, said shell being formed of a silica reinforced phenolic resin material;

first support means coupled to an inlet end of said shell for supporting the first end of each tube and for defining a barrier between said first fluid and said second fluid, said first support means being formed of a cotton reinforced phenolic resin material; and second support means coupled to an outlet end of said shell for supporting the second end of each tube and for defining a barrier between said first fluid and said second fluid, said second support means being formed of said cotton reinforced phenolic resin material.

15. The apparatus of claim 14, wherein each of said support means comprises first and second plate members and means for sealing between said first and second fluids, said first plate members defining a first group of apertures for receiving ends of said tubes and said sealing means and said second plate members defining a second group of apertures for alignment with said first group.

16. The apparatus of claim 15 wherein said sealing means comprises a plurality of tubular members having an inner diameter corresponding to the outer diameter of the tubes and a plurality of ring members, wherein each tubular member is disposed between a ring member and one of said second plate members.

17. The apparatus of claim 16 wherein apertures of said second group have a smaller diameter than apertures of said first group, wherein an edge surface of each tubular member engages said second plate member in abutting relation.

18. The apparatus of claim 14, further comprising first and second tubular head members formed of a thermally insulating phenolic resin material, said first and second tubular head members coupled at one end to said first and second support means, respectively, and covered at an opposite end by a cover plate, wherein said support means, head members and cover plates define respective inlet and outlet chambers for said first fluid and further wherein said inlet chamber includes a flame sprayed copper alloy coating therein.

* * * * *